US008579688B2

(12) United States Patent
Hall

(10) Patent No.: US 8,579,688 B2
(45) Date of Patent: Nov. 12, 2013

(54) VIDEO POKER GAME WITH REVEALED CARDS

(76) Inventor: Geoff Hall, Solihull (GB)

( * ) Notice: Subject to any disclaimer, the term of this patent is extended or adjusted under 35 U.S.C. 154(b) by 128 days.

(21) Appl. No.: 12/963,633

(22) Filed: Dec. 9, 2010

(65) Prior Publication Data

US 2011/0165926 A1 Jul. 7, 2011

Related U.S. Application Data

(60) Provisional application No. 61/287,171, filed on Dec. 16, 2009.

(51) Int. Cl.
*A63F 9/24* (2006.01)

(52) U.S. Cl.
USPC ..... 463/13; 463/9; 463/10; 463/11; 463/12

(58) Field of Classification Search
USPC ..... 463/10–12
See application file for complete search history.

(56) References Cited

U.S. PATENT DOCUMENTS

| | | | | |
|---|---|---|---|---|
| 6,110,040 | A | 8/2000 | Sanduski et al. | |
| 7,993,191 | B2 * | 8/2011 | Evans et al. | 463/13 |
| 8,062,119 | B2 * | 11/2011 | Stern et al. | 463/20 |
| 2007/0265051 | A1 * | 11/2007 | Tarantino | 463/16 |
| 2008/0318652 | A1 * | 12/2008 | Lima et al. | 463/13 |
| 2009/0179378 | A1 * | 7/2009 | Amaitis et al. | 273/292 |

* cited by examiner

*Primary Examiner* — Ronald Laneau
*Assistant Examiner* — Justin Myhr
(74) *Attorney, Agent, or Firm* — Muskin & Farmer LLC

(57) ABSTRACT

A method, system, and computer readable storage medium to provide a variation of a video poker game. The video poker game offers the player an ability to view "reveal cards" after the initial deal of five cards. The reveal card(s) show the values of some of the card(s) that are on top of the deck which would be dealt as replacement cards. The player, being able to view these reveal cards, can select his or her cards to hold using a more careful strategy than if the player had no such information.

10 Claims, 11 Drawing Sheets

PRIOR ART

PRIOR ART

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

VIDEO POKER GAME WITH REVEALED CARDS

CROSS REFERENCE TO RELATED APPLICATIONS

This application claims benefit to U.S. provisional application No. 61/287,171, filed on Dec. 16, 2009, entitled "Video Poker Game with Revealed Cards," which is incorporated by reference herein in its entirety for all purposes.

BACKGROUND OF THE INVENTION

1. Field of the Invention

The present inventive concept relates to a system, method, and computer readable storage, for playing a variation of the known game of video poker.

2. Description of the Related Art

Video poker games are well known the art. One disadvantage of video poker is when players draw, they have no idea what cards may be coming off the deck. This can result in a game with extremely unpredictable results and a mechanical game play.

U.S. Pat. No. 6,110,040 to Sanduski teaches a video poker game that offers the player to see the sixth card on each deal. The sixth card is the first card that will be dealt on the draw.

What is needed is a video poker game that allows players to see cards that may be dealt off the deck on the draw but in a more challenging and variable fashion.

SUMMARY OF THE INVENTION

It is an aspect of the present general inventive concept to provide an exciting improvement over video poker.

The above aspects can also be obtained by a method that includes (a) providing an electronic or physical deck of cards; (b) receiving a wager from a player; (c) dealing a player's initial hand comprising at least three cards; (d) displaying to the player a card value representing a card which is second from a top of the deck while not revealing to the player a card value representing a top card on the deck; (e) receiving, from the player, a selection of discard cards from the initial hand to replace; (f) replacing the discard cards using the deck to form a final hand; (g) evaluating a poker rank of the final hand; and (h) resolving the wager using the poker rank.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
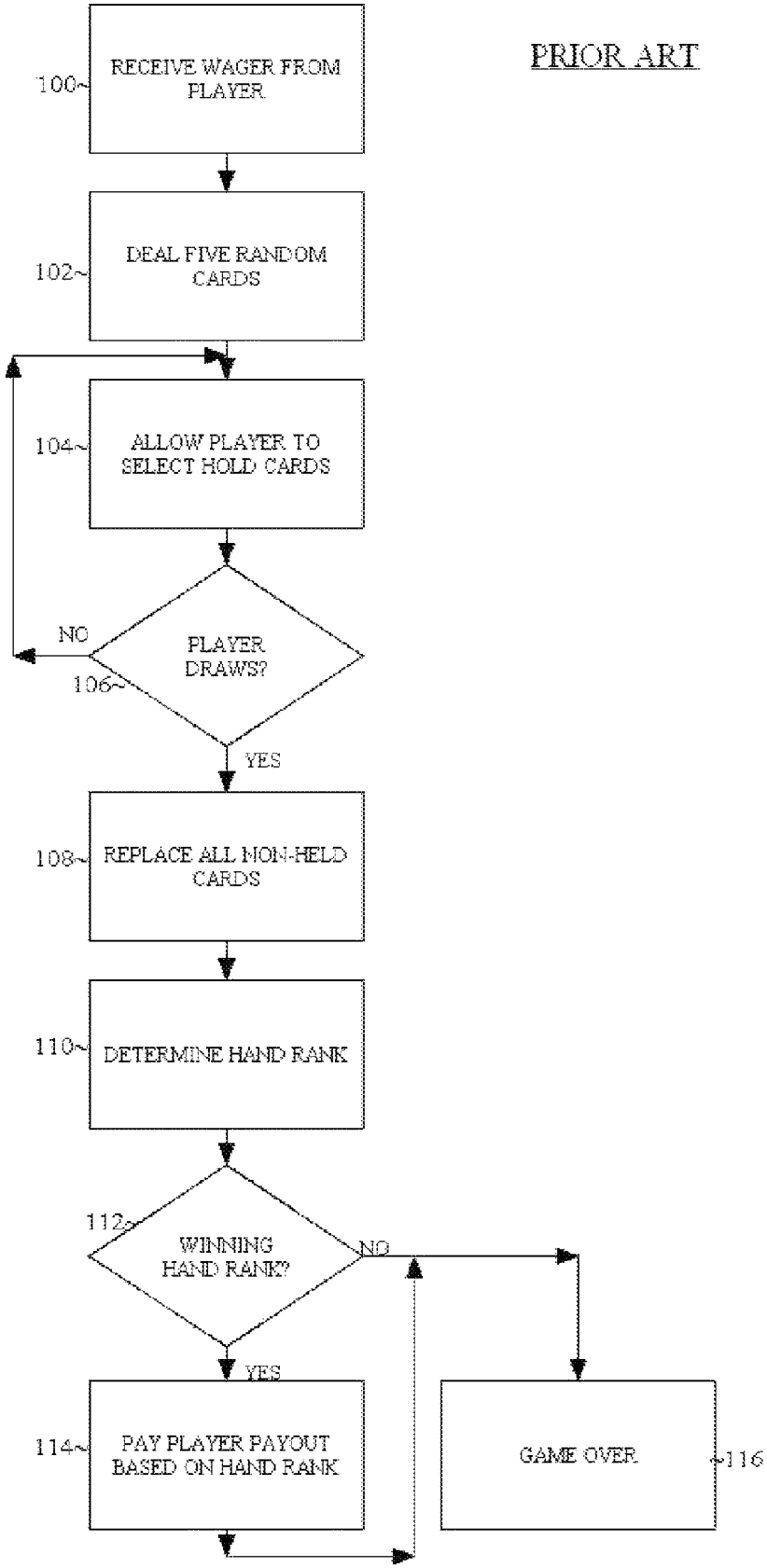
FIG. 1 is a flowchart illustrating the prior art game of video poker.

Reference will now be made in detail to the presently preferred embodiments of the invention, examples of which are illustrated in the accompanying drawings, wherein like reference numerals refer to like elements throughout.

The general inventive concept relates to a game involving video poker. Video poker is a well known game in the art, for example see U.S. Pat. No. 6,569,014, which is incorporated by reference here in its entirety.

FIG. 1 is a flowchart illustrating the prior art game of video poker. The goal is for the player to form the highest ranking poker final hand the player can make, wherein if the final hand is one of a predetermined number of winnings ranks, the player is paid for the rank of the final hand using a paytable.

The game can operate as follows. In operation 100, the machine receives a wager from a player. This is typically done by the player indicating to the machine how many credits he or she wants to bet (using buttons) and then presses a button to indicate that he or she wishes to begin a new game, upon which the number of credits bet is deducted from the player's credit meter. Initially, the player can make a cash deposit (or use a ticket/voucher, or electronic form of payment) in order to fund the credits in the machine.

From operation 100, the method proceeds to operation 102, which deals five random cards to the player. This can be considered the player's initial hand. Typically, a single standard 52 card deck is used, although in other variations, other types of decks can be used as well (e.g., decks with one or more wildcards). The five cards are typically dealt face up.

From operation 102, the method proceeds to operation 104, which allows the player to select the player's hold cards in the initial hand. The player's hold cards are cards which the player wishes to keep. Cards which are not hold cards are considered "discard cards." The player can indicate which of the cards are hold cards by touching the desired hold cards (on a touch-screen machine) or by pressing buttons. The player can also touch a card with "hold card" status and the status can be changed to no longer be a hold card.

From operation 104, the method proceeds to operation 106, which determines whether the player draws. In order to draw, the player can press a draw button which initiates a draw. If the player does not draw, the player is free to continue to change the desired hold cards (in operation 104) until the player is satisfied with his or her choice.

Once the player draws in operation 106, the method proceeds to operation 108, which replaces all the discard cards in the initial hand (cards which are not indicated as hold cards) with newly dealt cards from the virtual deck in order to form a final hand.

From operation 110, the method proceeds to operation 112, which determines a hand rank of the final hand. This can be done by comparing the cards in the final card to determine if they meet a particular defining criteria. Table I below is an exemplary video poker paytable which comprises a list of video poker hand ranks, although it can be appreciated that different variants of video poker can use different hand ranks and payouts.

TABLE I

| Hand | payout |
|---|---|
| Royal Flush | 250 |
| Straight Flush | 50 |
| Four of a Kind | 25 |
| Full House | 9 |
| Flush | 6 |
| Straight | 4 |
| Three of a Kind | 3 |
| Two Pair | 2 |
| Jacks or Better | 1 |
| Anything else | 0 |

From operation 110, the method proceeds to operation 112 which determines if the final hand is a winning hand rank. A winning hand rank is a rank on the paytable being used that has a payout greater than 0.

If the final hand rank is a winning rank, then the method proceeds to operation 114, which pays the player based on the hand rank. The payout is determines using a respective entry in the paytable which corresponds to the winning final hand rank multiplies by the number of coins bet. The payout is typically made in the form of credits that can be cashed out for real coins, or a ticket redeemable for cash at a kiosk, when the player wishes. From operation 114, the method proceeds to operation 116, wherein the game ends.

If the final hand rank is not a winning rank, then the method proceeds to operation 116, wherein the player is not paid a payout and the game ends. Of course, the player is free to begin a new game (by pressing appropriate buttons) and start again at operation 100 if the player so wishes.

Figure 2:
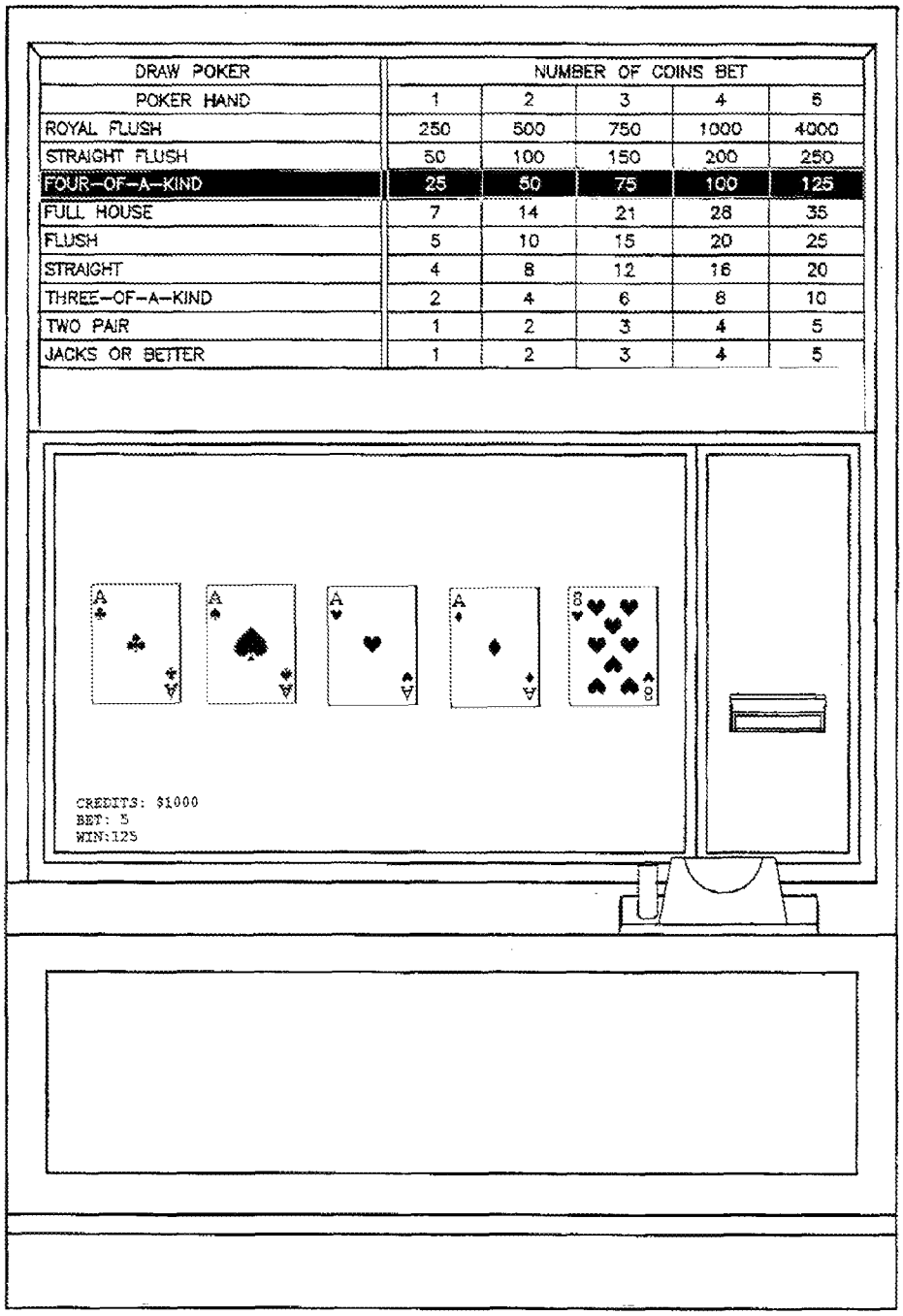
FIG. 2 is a drawing of one example of a video poker machine that can be used to implement methods herein, according to an embodiment.

FIG. 2 is a drawing of one example of a video poker machine that can be used to implement methods herein, according to an embodiment. Of course other types of machines can be used as well, including playing over the internet using a personal computer.

One deficiency in the method illustrated in FIG. 1 is that the player may find the game mundane and not sufficiently challenging. One way that the game of video poker can be made more exciting is by implementing a method wherein based on a rank of a final hand earned in a game, the player can earn the ability to peek at some cards that may be dealt on the draw.

Figure 3:
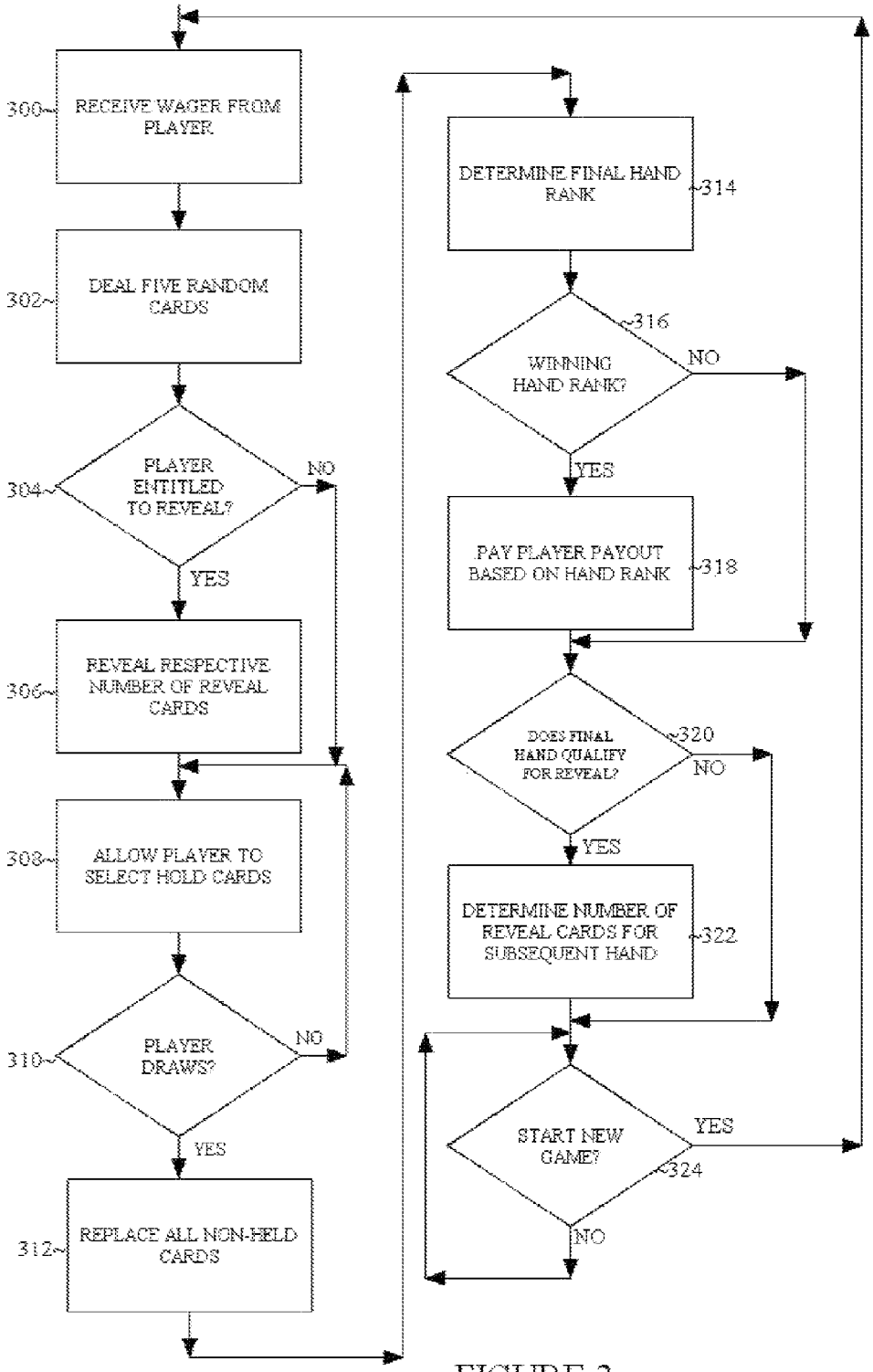
FIG. 3 is a flowchart illustrating an exemplary method of implementing a video poker game with revealed cards, according to an embodiment.

FIG. 3 is a flowchart illustrating an exemplary method of implementing a video poker game with revealed cards, according to an embodiment.

The method can begin with operation 300, which receives a wager from a player. This is typically done by the player indicating to the machine how many credits he or she wants to bet (using buttons) and then presses a button to indicate that he or she wishes to begin a new game, upon which the number of credits bet is deducted from the player's credit meter. Initially, the player can make a cash deposit (or use a ticket/voucher, or electronic form of payment) in order to fund the credits in the machine.

From operation 300, the method proceeds to operation 302, which deals five random cards. This can be considered the player's initial hand. Typically, a single standard 52 card deck is used, although in other variations, other types of decks can be used as well (e.g., decks with one or more wildcards). The five cards are typically dealt face up.

From operation 302, the method proceeds to operation 304, which determines whether the player is entitled to a reveal. This can be done based on predefined criteria. In one embodiment, the player would be entitled to a reveal if the player achieved a predetermined final hand in the previous game (see operations 320-322). If the player is not entitled to a reveal, then the method proceeds to operation 308.

If in operation 304, it is determined that the player is entitled to a reveal, then the method proceeds to operation 306 which reveals a respective number of reveal cards to the player. In an embodiment, the respective number of reveal cards is determined based on a rank of the player's final hand in the previous game. The reveal cards that are reveals are revealed in the order that they fall in the virtual deck. In other words, if an ace-diamonds is the first reveal card displayed and a 2-clubs is the second reveal card displayed, then the ace-diamonds is at the top of the deck and will be dealt first and then the 2-clubs will be dealt next. From operation 306, the method proceeds to operation 308.

In operation 308, the player selects his or her hold cards. The player's hold cards are cards which the player wishes to keep. Cards which are not hold cards are considered "discard cards." The player can indicate which of the cards are hold cards by touching the desired hold cards (on a touch-screen machine) or by pressing buttons. The player can also touch a card with "hold card" status and the status can be changed to no longer be a hold card.

From operation 308, the method proceeds to operation 310, which determines if the player draws. In order to draw, the player can press a draw button which initiates a draw. If the player does not draw, the player is free to continue to change the desired hold cards (in operation 308) until the player is satisfied with his or her choice.

Once the player draws in operation 310, the method proceeds to operation 312, which replaces all the discard cards in the initial hand (cards which are not indicated as hold cards) with newly dealt cards from the virtual deck in order to form a final hand.

From operation 312, the method proceeds to operation 314, which determines a final hand rank (the poker rank of the final hand). This can be done by comparing the cards in the final card to determine if they meet a particular defining criteria, such as those listed in Table I.

From operation 314, the method proceeds to operation 316, which determines if the final hand rank is a winning hand rank. A winning hand rank is a rank on the paytable being used that has a payout greater than 0.

If the final hand rank is a winning rank, then the method proceeds to operation 318, which pays the player based on the hand rank. The payout is determined using a respective entry in the paytable which corresponds to the winning final hand rank multiplied by the number of coins bet. The payout is typically made in the form of credits that can be cashed out for real coins, or a ticket redeemable for cash at a kiosk, when the player wishes. From operation 318, the method proceeds to operation 320.

If in operation 316, it is determines that the final hand rank is not a winning hand rank (e.g., the final hand is not a winner), then the method proceeds to operation 320.

In operation 320, it is determined whether the final hand qualifies for a reveal on the very next game. In one embodiment, this can be done based on the rank of the final hand rank, e.g., certain ranks would qualify the player for the reveal on the very next game.

If in operation 320 it is determines that the final hand qualifies for a reveal on the very next game, then the method proceeds to operation 332, which determines a number of reveal cards for the reveal on the very next game. In one embodiment, certain ranks would qualify the player for a reveal of different card numbers, e.g., a straight would give the player a one-card reveal on the very next game, while a straight flush would give the player a five-card reveal on the very next game. A paytable (or pay-schedule) such as that in Table II can be used to determine the number of reveal cards. The method can then proceeds to operation 324.

TABLE II

| Hand | Reveal cards awarded |
|---|---|
| Royal Flush | 0 |
| Straight Flush | 5 |
| Four of a Kind | 4 |
| Full House | 3 |
| Flush | 2 |
| Straight | 1 |
| Three of a Kind | 0 |
| Two Pair | 0 |
| Jacks or Better | 0 |
| Anything else | 0 |

If in operation 320 it is determines that the player does not qualify for a reveal on the very next game, then the method proceeds to operation 324, which gives the player the option to begin a new game. It is noted that if it was determined that the player earned a reveal in operation 320, then on the immediate new game the player would be awarded the reveal as determined in operations 322-322. Typically, an earned reveal would only apply to a subsequent game of an equal number of credits that were bet on the game that earned the player the reveal. For example, if the player bet 1 credit and earned a reveal on the subsequent (very next) game, then the player would only be allowed to bet 1 credit on the subsequent (very next) game. If the player bet more than one credit, in one embodiment the player would lose his or her right to the reveal. This is simply to prevent a player from betting low until they earn a reveal, and then taking advantage of the reveal by betting more credits on the hand that provides for the reveal.

It is noted that the order of operations in FIG. 3 can be performed in any sensible order. For example, the revealing of reveal cards (operation 306) can occur before the five random cards of the initial hand are dealt (operation 302).

Furthermore, while the qualifying condition for earning reveal card(s) described above is based upon the rank of the final hand in the immediately preceding game, it can be appreciated that other conditions and terms for earning reveal card(s) can be used as well. For example, the player can earn reveal cards based on the initial hand dealt (in operation 302) and the reveal cards are then displayed immediately (thus each game is independent). Table III illustrates a paytable which determines how many reveal cards are displayed based on the rank (or qualities) of the initial hand.

TABLE III

| Hand | Reveal cards awarded |
|---|---|
| Four to a royalflush | 1 |
| Three to a flush | 3 |
| Any pair | 3 |
| Four cards of same color | 2 |
| Three of a kind | 2 |
| Three to a straight | 4 |

For example, using the paytable in Table III, if the player is dealt a four to a royal hand, then the game will automatically display one reveal card (the sixth or next card to be dealt). Thus, the player will know if he or she will get the royal by drawing only one card and can plan their strategy accordingly. In this embodiment, operations 320-322 would not be needed and instead the reveal card determination would occur in operation 302, wherein operations 304-306 would display the respective reveal cards if any were earned.

Tables IV and V below are additional exemplary paytables which determines how many reveal cards to display based on the rank (or qualities) of the initial hand. If a hand rank falls below the lowest listed hand then the hand rank earns zero reveal cards.

TABLE IV

| Hand | Reveal cards awarded |
|---|---|
| Flush, or higher | 4 |
| Straight | 3 |
| 3 of a kind | 2 |
| 2 pair | 1 |

TABLE V

| Hand | Reveal cards awarded |
|---|---|
| Full house or higher | 4 |
| Flush | 3 |
| Straight | 2 |
| 3 of a kind | 1 |

In another embodiment, the determination of whether to display reveal cards can be made randomly. In a further embodiment, the ability to view reveal cards can be purchased by the player (for credits), either at the beginning of the game (before the player views any cards) or after the initial deal (in operation 302) but before the player draws. The price for reveal cards can increase with increasing number of reveal cards, for example, to buy one reveal card would cost one credit, to buy two reveal cards would cost two credits, to buy three reveal cards would cost 4 credits, etc.

Figure 4A:
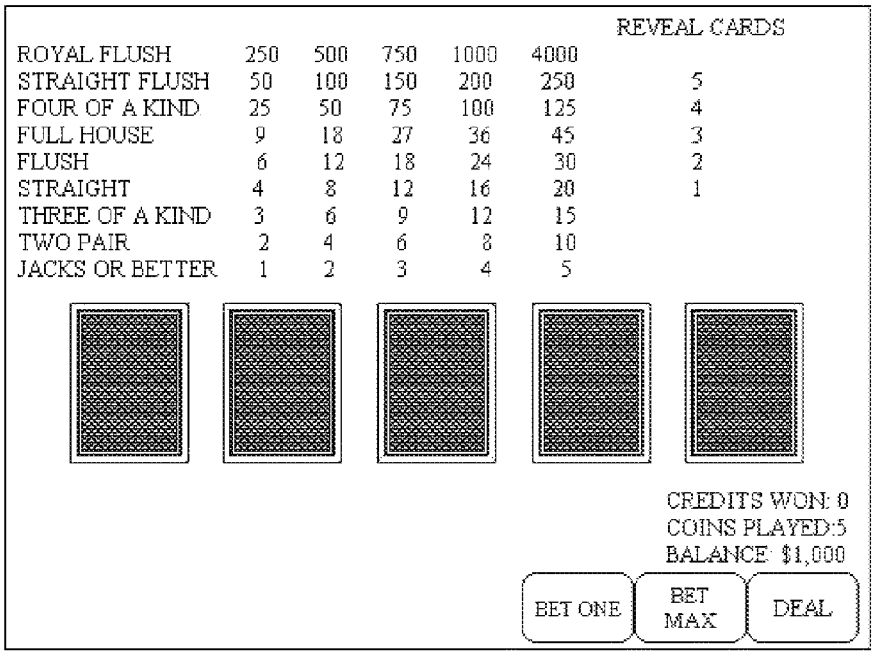
FIG. 4A is drawing of a first phase of an exemplary first game, according to an embodiment.

FIG. 4A is drawing of a first phase of an exemplary first game, according to an embodiment.

Note that to the right of the regular paytable is a reveal cards paytable, which shows how many reveal cards on the next game each final hand will earn. For example, if the player gets a straight flush on this game as his or her final hand, then the player has earned 5 reveal cards on the very next game. If the player gets jacks or better on the final hand, then the player has not earned any reveal cards on the very next game. Of course this paytable is subject to change and this is just one example.

In this example, the player bets five coins and starts the game.

Figure 4B:
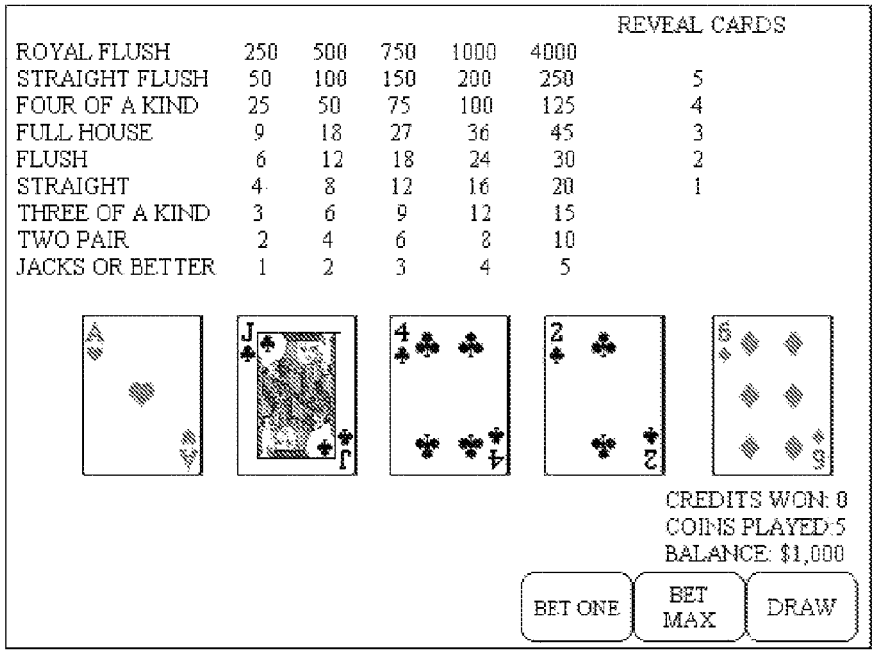
FIG. 4B is a drawing of a second phase of an exemplary first game, according to an embodiment.

FIG. 4B is a drawing of a second phase of an exemplary first game, according to an embodiment. Subsequent to FIG. 4A, the game has now dealt the player five random cards from the virtual deck.

Figure 5A:
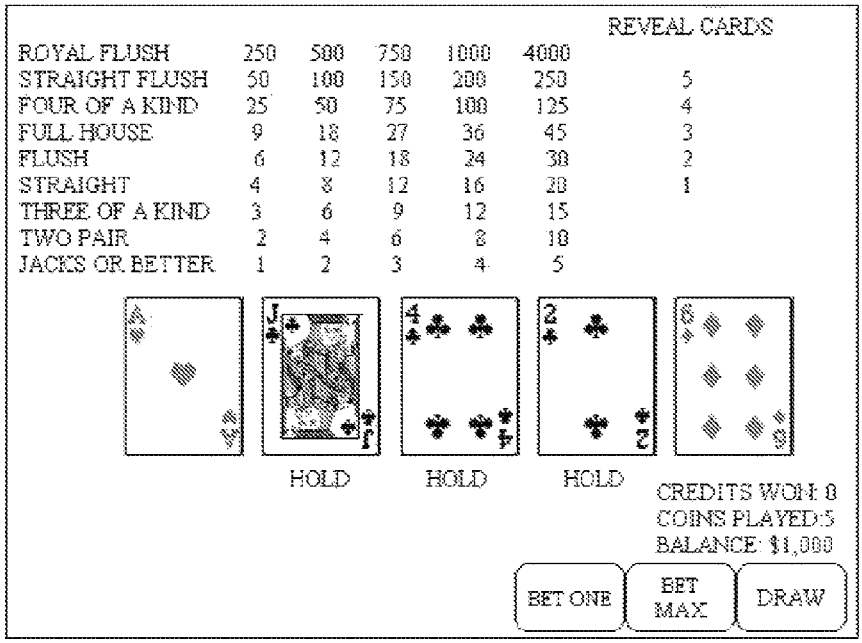
FIG. 5A is drawing of a third phase of an exemplary first game, according to an embodiment.

FIG. 5A is drawing of a third phase of an exemplary first game, according to an embodiment.

After viewing the cards from FIG. 4B, the player now decides to hold the jack of clubs, four of clubs, and two of clubs by touching those cards (these become the hold cards, while the remaining cards of ace hearts and six diamonds are the discard cards). The player here is hoping to make a flush (of clubs).

Figure 5B:
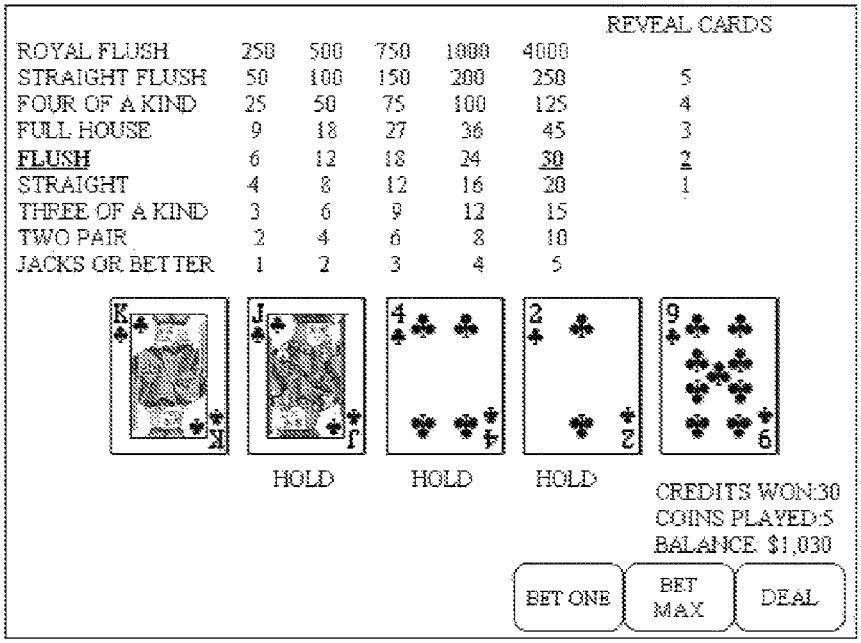
FIG. 5B is a drawing of a fourth phase of an exemplary first game, according to an embodiment.

FIG. 5B is a drawing of a fourth phase of an exemplary first game, according to an embodiment.

After the player presses "draw" in FIG. 5A, the video poker machine discards the discard cards (ace hearts and six of diamonds) and replaces them with the two cards on the top of the virtual deck, the king clubs and the nine clubs, to form a final hand. The rank of the final hand (the final hand poker rank) is a flush. Therefore, the player has won 30 credits and has also earned a reveal of 2 cards on the very next game. This game is now over.

The player can cash out, but the player would lose the 2 reveal cards the player has earned on the very next game. Thus, the player would be advised to play the next game and then cash out as to not lose the two earned reveal cards, which will work to the player's advantage on the very next game.

Figure 6A:
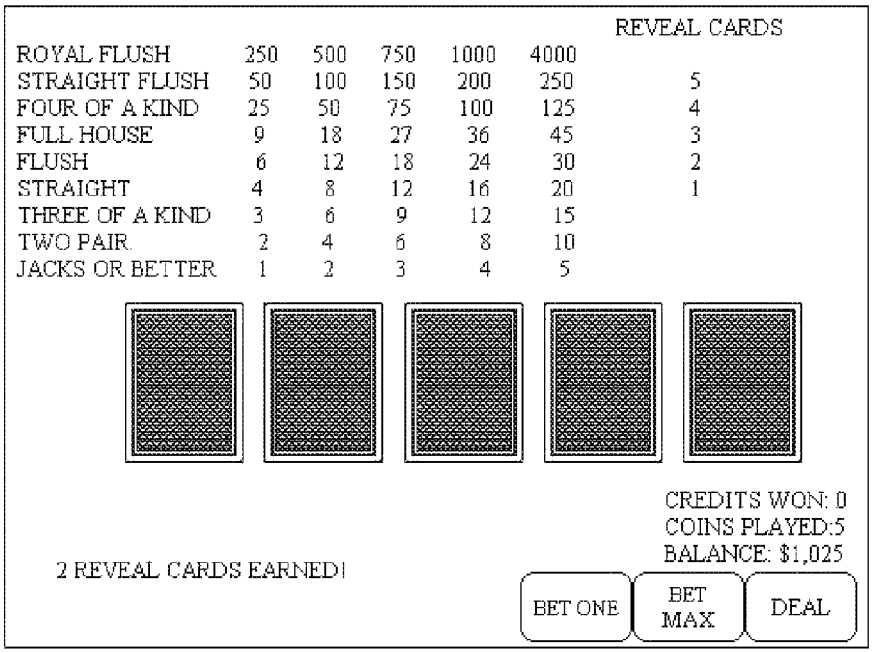
FIG. 6A is drawing of a first phase of an exemplary subsequent game, according to an embodiment.

FIG. 6A is drawing of a first phase of an exemplary subsequent game, according to an embodiment.

The player in FIG. 5B presses the deal button to player a new game, again betting five coins, begin a new game. Note that the game indicates to the player that the player has earned two reveal cards.

Figure 6B:
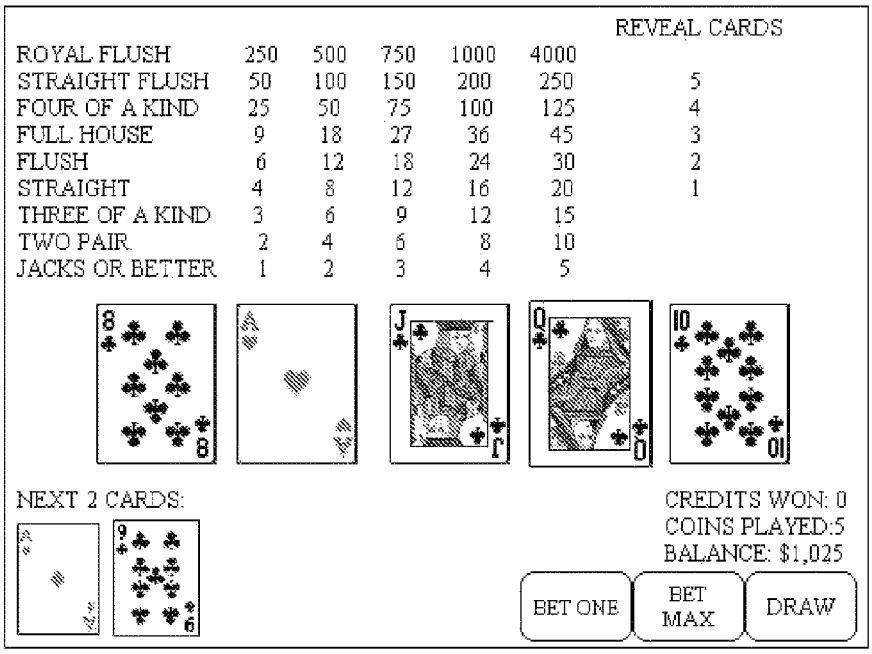
FIG. 6B is a drawing of a second phase of an exemplary subsequent game, according to an embodiment.

FIG. 6B is a drawing of a second phase of an exemplary subsequent game, according to an embodiment.

Subsequent to FIG. 6A, the game now deals the five cards comprising the initial hand, and the display also shows the player two reveal cards (ace diamonds, nine clubs) in the bottom left of the display. Two reveal cards are shown because in the game immediately before this game, the player earned two reveal cards because the player got a final hand of flush (see FIG. 5B).

So now the player knows that the very next card to be dealt is an ace of diamonds, and the card after that to be dealt is a nine of clubs. The player can use this information to determine an optimal playing strategy. In this example, if the player did not know that next two cards in the deck, the player should hold all cards but the ace of hearts in order to go for a straight flush. However, since the player knows that the next card to be dealt is an ace of diamonds, if the player played this hand that way the player would end up losing the game. While the second card in the deck is the nine of clubs, which would form the straight flush, in this situation it would be impossible for the player to form the straight flush because in order to get the nine of clubs the player would have to discard two cards and draw the ace of diamonds first.

Since the first card to be dealt is an ace diamonds, the player knows that by discarding at least one card from the initial hand (but not discarding the ace hearts), the player will make a pair of aces which is a winning payout. So the player decides to hold the ace hearts and discard all of the remaining cards. Using this strategy, the player will have at least a pair of aces but can also make other hands such as three of a kind (three aces or three nines) or four aces, or a full house or two pair.

It is noted as a matter of terminology that the "first card" (the ace of diamonds) can also be considered the "top card" in the deck or "first card" in the deck. The "second card" (the 9-clubs) can also be considered the card "immediately next to the top card" or "immediately below the top card" or "second-most from the top" or "second card in the deck." It is noted that after a card is dealt, e.g., in the initial hand, it is no longer part of the "deck."

Figure 7A:
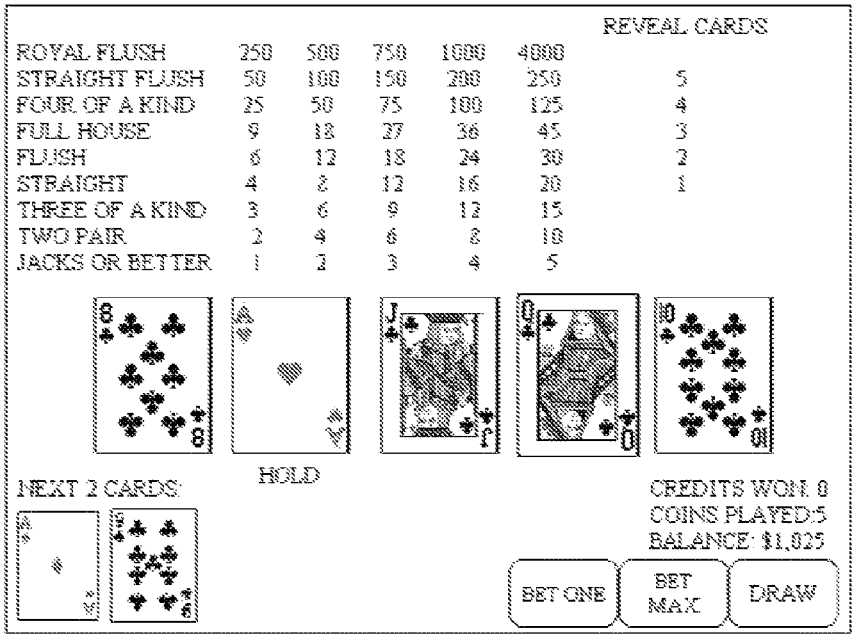
FIG. 7A is drawing of a third phase of an exemplary subsequent game, according to an embodiment.

FIG. 7A is drawing of a third phase of an exemplary subsequent game, according to an embodiment.

Subsequent to FIG. 6B, the player decides to hold only the ace of hearts, as indicated in FIG. 7A. The player then presses the draw button.

Figure 7B:
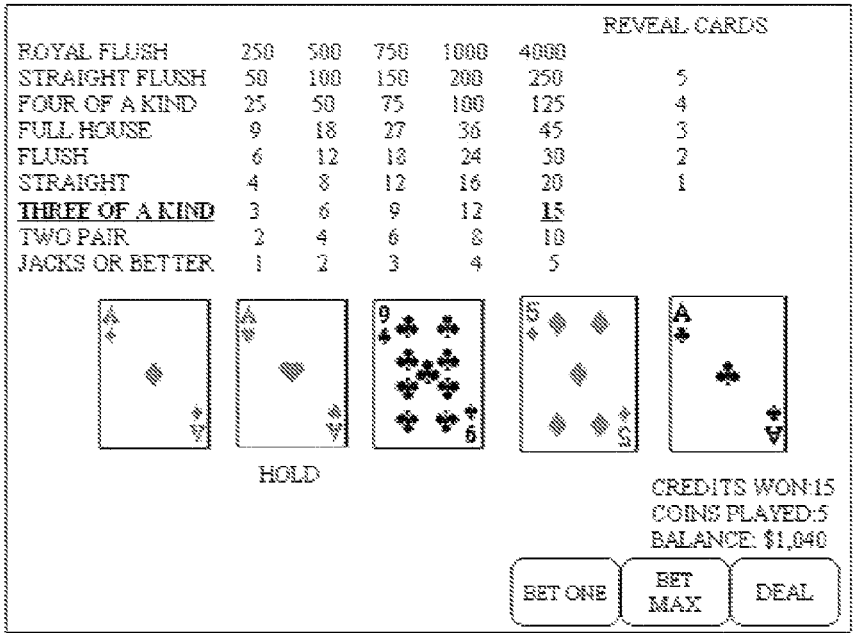
FIG. 7B is a drawing of a fourth phase of an exemplary subsequent game, according to an embodiment.

FIG. 7B is a drawing of a fourth phase of an exemplary subsequent game, according to an embodiment.

The first reveal card (the ace of diamonds) is dealt to replace the leftmost card that is discarded (the eight of clubs), while the second reveal card (the nine of clubs) is dealt to replace the next card horizontally that is discarded (the jack clubs). In an alternative embodiment, cards can be dealt off the deck from right to left (instead of from left to right). In a further embodiment, cards can be dealt into the initial hand in random positions.

In this example, the player has luckily drawn a third ace, giving the player three of a kind with a payout of 15 coins. Looking at the reveal card paytable, three of a kind does not entitle the player to a reveal on the very next hand.

Figure 8A:
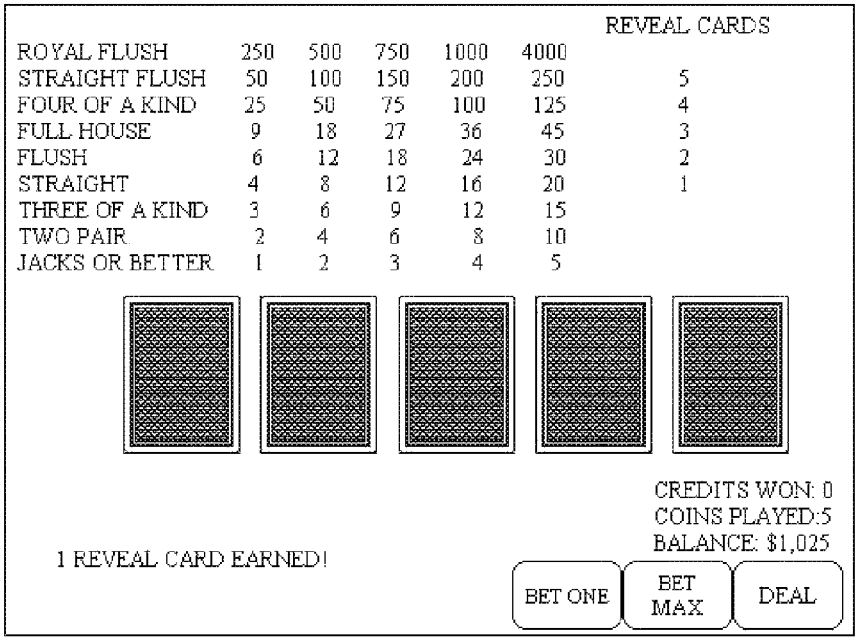
FIG. 8A is drawing of a first phase of a second exemplary subsequent game, according to an embodiment.

FIG. 8A is drawing of a first phase of a second exemplary subsequent game, according to an embodiment.

In an alternate embodiment, reveal cards can comprise face up and face down cards. FIG. 8A can follow from FIG. 5B (or any game where the player has earned two reveal cards). The player bets five credits.

Figure 8B:
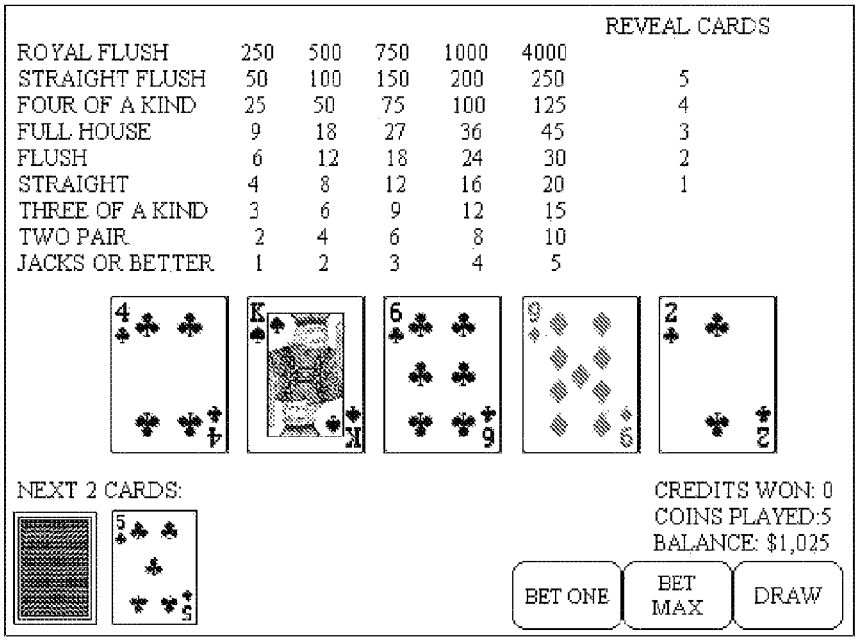
FIG. 8B is a drawing of a second phase of a second exemplary subsequent game, according to an embodiment.

FIG. 8B is a drawing of a second phase of a second exemplary subsequent game, according to an embodiment.

The initial hand dealt is four clubs/kind spades/six clubs/nine diamonds/two clubs. The player is also shown two reveal cards of/face down/five clubs. The value of the face down reveal card, which is at the top of the deck, is unknown to the player. The second card in the deck is the five clubs.

According to advanced video poker strategy, without seeing the reveal cards, the player would keep the king high and discard all of the other cards. Since the player sees that the seventh card (second reveal card) is a five clubs, the player knows that by drawing two cards, the player will at least have four to a straight flush. The sixth card (first reveal card) is unknown but of course the player is hoping that it is a three of clubs.

Figure 9A:
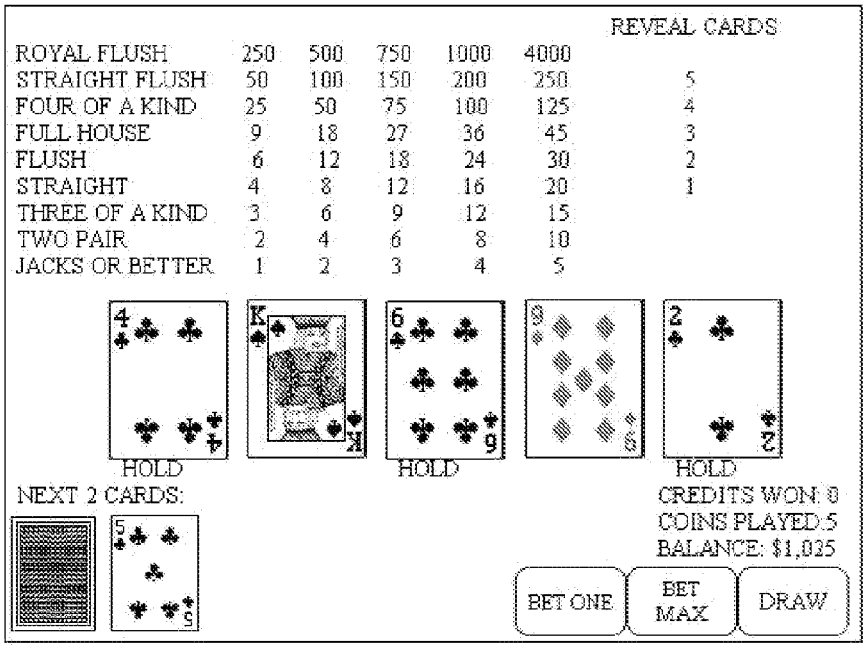
FIG. 9A is drawing of a third phase of a second exemplary subsequent game, according to an embodiment.

FIG. 9A is drawing of a third phase of a second exemplary subsequent game, according to an embodiment.

Thus, from FIG. 8B, the player decides to hold the four clubs, six clubs, and two clubs. The player then draws.

Figure 9B:
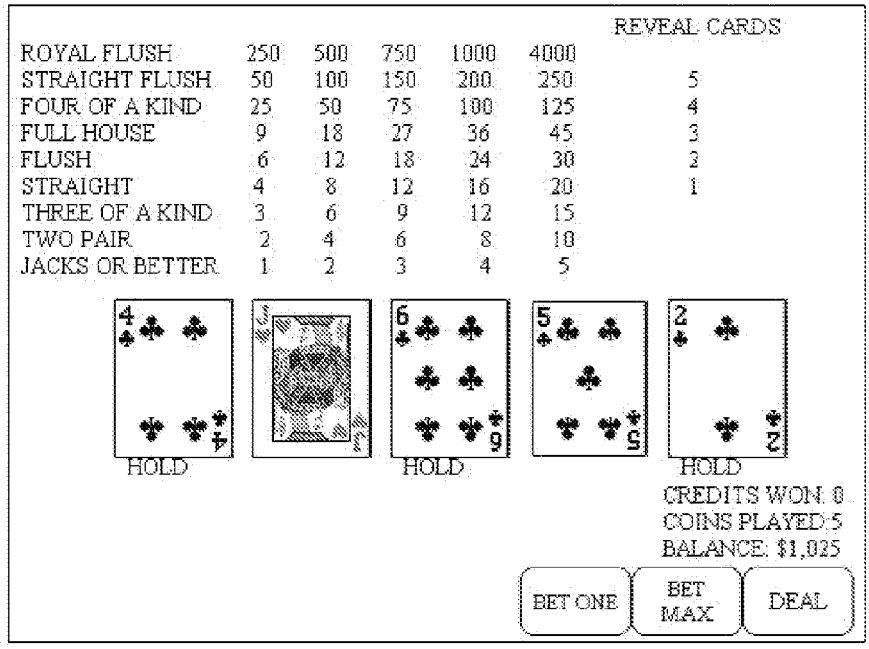
FIG. 9B is a drawing of a fourth phase of a second exemplary subsequent game, according to an embodiment.

FIG. 9B is a drawing of a fourth phase of a second exemplary subsequent game, according to an embodiment.

On the draw, the game replaces the discard cards with the cards remaining in the virtual deck, in order. In other words, the first reveal card is dealt first, the second reveal card is dealt second, etc. Unfortunately for the player, the first reveal card is a jack of hearts, thereby leaving the player with a losing final hand.

Figure 10:
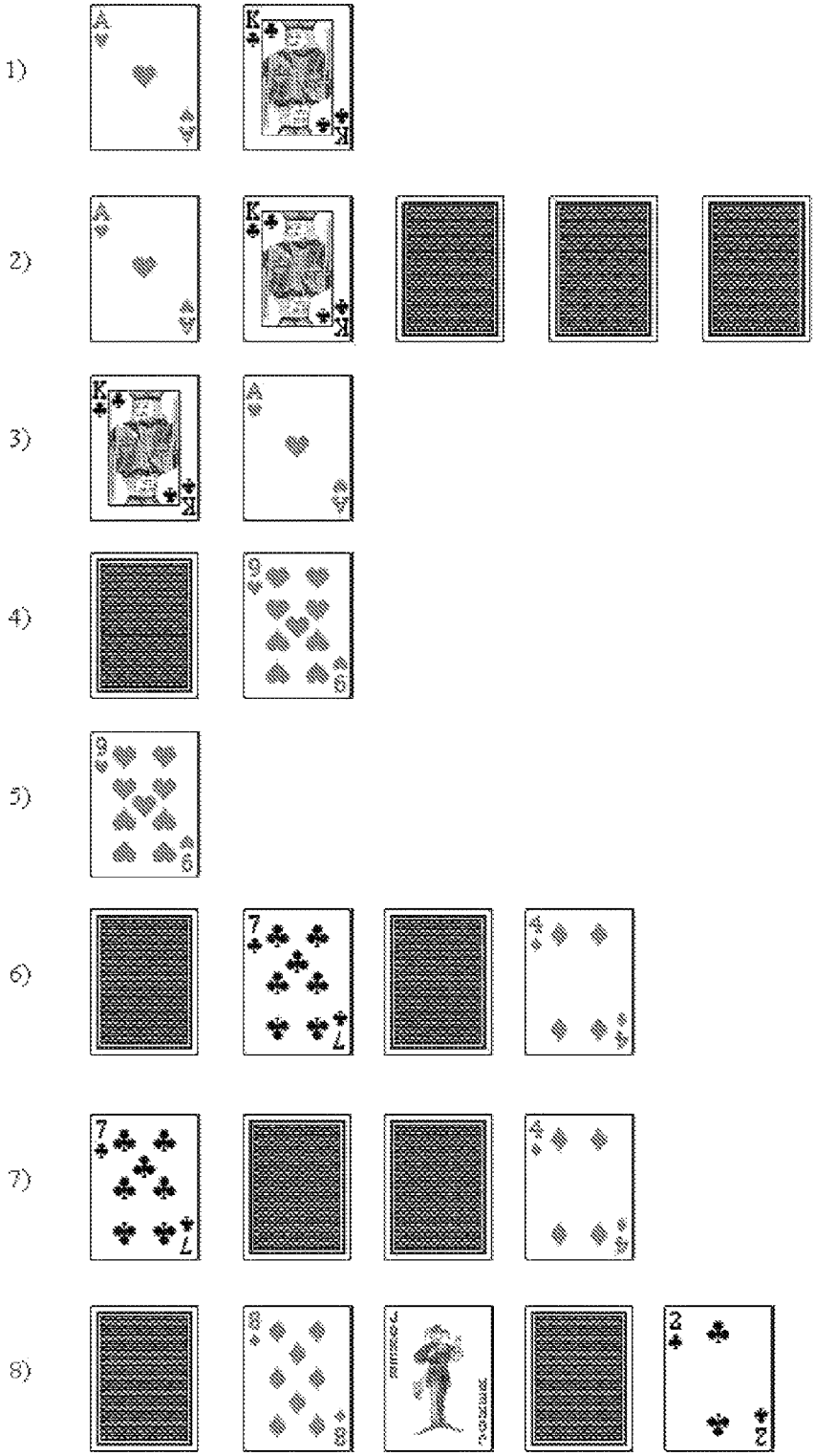
FIG. 10 is drawing of numerous examples of configurations of reveal cards and their presentations, according to an embodiment.

FIG. 10 is drawing of numerous examples of configurations of reveal cards and their presentations, according to an embodiment.

In the first example, the first reveal card is an ace-hearts and the second reveal card is a king-clubs.

In the second example, the first reveal card is an ace-hearts, the second reveal card is a king-clubs, and the third, fourth and fifth reveal cards are face down (value unknown to player). The first example and the second example have the same effect in the game, but for their presentation (two cards versus five cards).

In the third example, the first reveal card is a king-clubs and the second reveal card is ace-hearts. This is not the same as the previous two examples, as if the player draws only one card, in the third example he will draw a king-clubs (instead of an ace-hearts as in the prior two examples). If the player draws at least two cards, then the first three examples will have the same effect. However, the only exception would be a poker game which is order specific, e.g., some versions video poker versions may pay different amounts based on the actual order of the cards in the final hand. In this situation, the third example is different than the first two examples in that the order the cards are dealt and placed into the player's hand will be different.

The fourth example shows a first reveal card which is face down and the second reveal card of a nine-hearts. If the player only draws one card, then the player has no additional information about the card that will be dealt (the first reveal card), other than it is not a nine-hearts. If the player draws two or more cards, the first card dealt and put into the player's hand will be the face down card, the second card will be the nine-hearts. No other information is known about any other cards that may be drawn.

The fifth example simply shows a single reveal card of nine-hearts. This is different from the previous example (example number 4) in that in the fifth example, the first card drawn and used is the nine-hearts, while in the fourth example the second card drawn and used is the nine-hearts.

The sixth example shows a first reveal card of face down, second reveal card of seven-clubs, third reveal card of face down, and fourth reveal card of four-diamonds.

The seventh example shows a first reveal card of seven-clubs, second reveal card of face down, third reveal card of face down, and fourth reveal card of four-diamonds. If the player draws two or more cards, then the sixth and seventh examples will have the same effect (with the exception noted in example three).

The eighth example shows a first reveal card of face down, second reveal card of eight-diamonds, third reveal card of joker (wild card), fourth reveal card of face down, and fifth reveal card of two-clubs. The wild card is used a joker-poker variation which uses one or more jokers (wild cards) in the deck. Of course, using wild card(s) is optional and is not required. If the player draws all five cards (discards all cards in the initial hand), then the player is essentially exchanging his or her current hand for the hand comprised of all five reveal cards.

Of course the above examples are provided for illustrative purposes and are not exhaustive, it can be appreciated that any combination of cards values (including face down cards) can comprise the plurality of reveal cards shown to the player.

Figure 11:
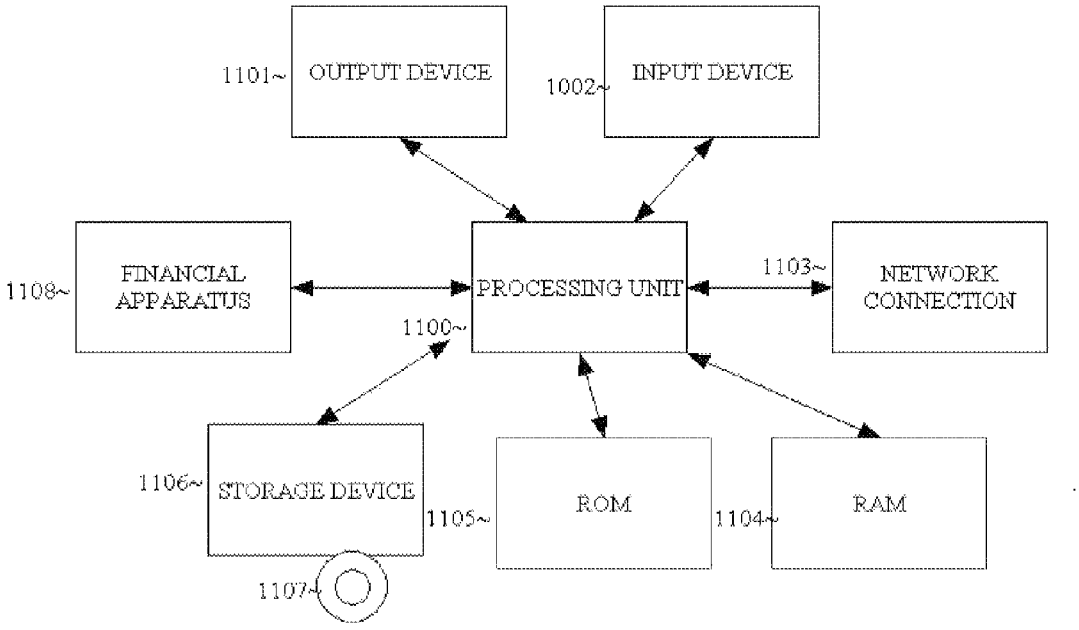
FIG. 11 is a block diagram illustrating hardware that can be used to implement the wagering methods, according to an embodiment.

FIG. 11 is a block diagram illustrating hardware that can be used to implement the wagering methods, according to an embodiment. The hardware can be, for example, an electronic gaming machine (EGM) used in casinos. The hardware can also be a personal computer, playing the game using the Internet at an Internet casino for real money.

A processing unit 1100 (such as a microprocessor and any associated components) is connected to an output device 1101 (such as an LCD monitor, touch screen, CRT, etc.) and an input device 1102 (e.g., buttons, a touch screen, a keyboard, mouse, etc.) The processing unit 1100 can also be connected to a network connection 1003, which can connect the electronic gaming device to a computer communications network such as the Internet, a LAN, WAN, etc. The processing unit 1100 is also connected to a RAM 1104 and a ROM 1105. The processing unit 1100 is also connected to a storage device 1106 which can be a DVD-drive, CD-ROM, flash memory, etc. A computer readable storage medium 1107 can store a program which can control the electronic device to perform any of the methods described herein. The processing unit 1100 can also be connected to a financial apparatus 1108 which can receive cash and convert the received cash into playable credits for use by the player when playing the electronic device. When the player decides to cash out any remaining credits, the financial apparatus 1108 can issue coins or a cashless ticket (voucher) for the remaining credits which is redeemable by the player.

It is noted that the methods described herein are typically played with a single deck of cards, although in other embodiments more than one deck can be used. A standard deck of 52 cards can be used, as well as other kinds of decks, such as Spanish decks, decks with wild cards, etc. The operations described herein can be performed in any sensible order. Furthermore, numerous different variants of house rules can be applied.

Methods herein can be applied to any version of video poker, such as (but not limited to) double bonus, double double bonus, joker poker, deuces wild, etc. Methods described herein can also be applied to a casino player versus dealer poker game, wherein a player tries to make his or her best poker hand by discarding and drawing cards, and then comparing their hand against a dealer's hand.

Methods described herein can also be played on a physical table using physical cards and physical chips used to place wagers. Such physical chips can be directly redeemable for cash.

Initial cash deposits can be made into the electronic gaming machine which converts cash into electronic credits. Wagers can be placed in the form of electronic credits, which can be cashed out for real coins or a ticket (e.g., ticket-in-ticket-out) which can be redeemed at a casino cashier or kiosk for real cash and/or coins.

The descriptions provided herein also include any hardware and/or software known in the art and needed to implement the operations described herein. Further, all methods described herein can be programmed on a digital computer and stored on any type of computer readable storage medium.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus to play video poker, the apparatus comprising:

an input unit and an output unit;

a processing unit operationally connected to the input unit and the output unit, the processing unit configured to:

provide an electronic deck of cards;

allow the player to complete a first video poker game;

determine, based on a final hand in the first video poker game, whether a second video poker game qualifies for reveal card(s);

deal an initial poker hand from a virtual deck of cards for the second video poker game;

determine if the second video poker game qualified for reveal card(s), and if so, then displaying the reveal card(s) which are undealt card values in the virtual deck, a number of reveal card(s) displayed being determined based on the final hand in the first video poker game;

allow the player to select and replace discard cards in the initial poker hand to form a final poker hand, the discard cards replaced with cards dealt from the virtual deck.

2. The apparatus as recited in claim 1, wherein the discard cards are replaced with card(s) in the virtual deck in order.

3. The apparatus as recited in claim 1, wherein the reveal card(s) comprise at least one face down card followed by at least one face up card.

4. The apparatus as recited in claim 1, wherein two reveal cards are displayed, a first reveal card is a face down card a second reveal card is a face up card with its respective value.

5. The apparatus as recited in claim 1, wherein three reveal cards are displayed, a first reveal card is a face down card, and a second and third reveal cards are two face up cards with their respective values.

6. A method to play video poker, the method comprising:

executing computer readable instructions on an electronic processing unit which perform the following operations:

providing an electronic deck of cards;

allowing the player to complete a first video poker game;

determining, based on a final hand in the first video poker game, whether a second video poker game qualifies for reveal card(s);

dealing an initial poker hand from a virtual deck of cards for the second video poker game;

determining if the second video poker game qualified for reveal card(s), and if so, then displaying the reveal card(s) which are undealt card values in the virtual deck, a number of reveal card(s) displayed being determined based on the final hand in the first video poker game;

allowing the player to select and replace discard cards in the initial poker hand to form a final poker hand, the discard cards replaced with cards dealt from the virtual deck.

7. The method as recited in claim 6, wherein the discard cards are replaced with card(s) in the virtual deck in order.

8. The method as recited in claim 6, wherein the reveal card(s) comprise at least one face down card followed by at least one face up card.

9. The method as recited in claim 6, wherein two reveal cards are displayed, a first reveal card is a face down card a second reveal card is a face up card with its respective value.

10. The method as recited in claim 6, wherein three reveal cards are displayed, a first reveal card is a face down card, and a second and third reveal cards are two face up cards with their respective values.

* * * * *